US005170216A

United States Patent [19]

Takatsuki et al.

[11] Patent Number: 5,170,216

[45] Date of Patent: Dec. 8, 1992

[54] IMAGE FORMING APPARATUS PROVIDED WITH AN AUTOMATIC DOCUMENT FEEDER

[75] Inventors: Yasushi Takatsuki, Neyagawa; Masami Shibahara, Sakai; Yoshihiko Tanaka, Moriguchi, all of Japan

[73] Assignee: Mita Industrial Co., Ltd., Osaka, Japan

[21] Appl. No.: 755,394

[22] Filed: Sep. 5, 1991

[30] Foreign Application Priority Data

Sep. 18, 1990 [JP] Japan ..... 2-249823

[51] Int. Cl.[5] ..... G03G 15/00

[52] U.S. Cl. ..... 355/319; 355/313; 355/24

[58] Field of Search ..... 355/319, 313, 23, 24; 271/288, 301, 291

[56] References Cited

U.S. PATENT DOCUMENTS 4,641,954 2/1987 Miyata et al. .

4,922,306 5/1990 Araki et al. ..... 355/313

*Primary Examiner*—Richard L. Moses

*Attorney, Agent, or Firm*—Jordan and Hamburg

[57] ABSTRACT

An image forming apparatus comprises a document feeder for feeding a plurality of documents one by one, a copy paper feeder for feeding a copy paper sheet having a front surface and a rear surface onto which document images are transferable, an image transferring assembly for transferring an image of the fed document onto a copy paper sheet, an operable unit for discharging the copy paper sheet or temporarily retaining the copy paper sheet therein to refeed the sheet to the image transferring assembly when a next document is fed, a mode setting key for selectively setting in advance either of a first mode in which the copy paper sheet onto which the last document image is transferred is forcibly discharged or a second mode in which the copy paper sheet onto which the last document image is transferred is temporarily retained in the operable unit, and a CPU. The CPU determines that an image of a last document of the plurality of documents has been transferred onto one of the two surfaces of the copy paper sheet and determines in accordance with the result of the above determination that the last document image is transferred onto a front surface of the copy paper sheet. Further, based on the determination as to whether the last document image is transferred onto the front surface of the copy paper sheet and the mode set by the mode setting key, the CPU controls the operable unit so as to execute one of the operations of discharging the copy paper sheet onto the rear surface of which the image of the document is transferred, discharging the copy paper onto the front surface of which the last document image is transferred in the case where the first mode is selected, and retaining therein the copy paper onto the front surface of which the last document image is transferred in the case where the second mode is selected.

6 Claims, 2 Drawing Sheets

IMAGE FORMING APPARATUS PROVIDED WITH AN AUTOMATIC DOCUMENT FEEDER

BACKGROUND OF THE INVENTION AND RELATED ART STATEMENT

The present invention relates to an image forming apparatus which automatically feeds a plurality of simplex documents one by one and transfers images of the fed documents successively onto both surfaces of copy paper sheets.

Japanese Unexamined Patent Publication No. 57-212460 discloses an image forming apparatus capable of making duplex copies from simplex documents. In the apparatus, the simplex documents set in an automatic document feeder (hereinafter referred to as an ADF) are automatically fed to be exposed, so that an image of one document is transferred onto a front surface of a copy paper sheet and an image of the next document is transferred onto a rear surface of the same copy paper sheet. Here, the front surface and the rear surface of the copy paper sheet mean respectively a first surface and a second surface of the copy paper sheet onto which document images are transferred successively.

In the above image forming apparatus, in the case where an image of a last document is transferred onto a front surface of a copy paper sheet, the copy paper sheet is retained in an intermediate tray provided in the image forming apparatus. Accordingly, there have been proposed the following two types of apparatus to handle the copy paper sheet retained in the intermediate tray with the front surface thereof copied with the last document image:

1) The copy paper sheet retained in the intermediate tray is forcibly discharged therefrom;

2) The copy paper sheet retained in the intermediate tray remains to be therein until a next document is to be fed in the ADF.

Incidentally, only a limited number of documents can be fed by the ADF. Accordingly, in the case where a great number of documents are to be copied, it is required that the documents are divided into a plurality of sets as to be fed by the ADF appropriately. However, in the image forming apparatus in which the copy paper sheet onto which the last document image is transferred is forcibly discharged from the intermediate tray irrespective of whether the last document image is transferred onto the front surface or the rear surface of the copy paper sheet, it is impossible to transfer an image of a first document of a next set fed in the ADF onto the rear surface of the last copy paper sheet of the preceding document set even if the last document image of the preceding set is transferred onto the front surface of the copy paper sheet. As a result, the copy paper sheet carrying the image of the last document of each set is destined to be wasted when the last document image is transferred onto the front surface of the copy paper.

On the other hand, in the image forming apparatus in which the copy paper sheet onto the front surface of which the last document image is transferred remains to be retained in the intermediate tray until the first document of the next document set is fed in the ADF, the following problem occurs. In the case where all the documents can be fed in one time, it is required that the copy paper sheet retained in the intermediate tray with the last document image transferred onto the front surface thereof be discharged therefrom with the use of a control key or the like, resulting in a cumbersome operation.

SUMMARY OF THE INVENTION

In consideration of the above drawbacks, it is an object of the invention to provide an image forming apparatus capable of, prior to a copying operation, selectively designating whether a copy paper sheet onto a front surface of which an image of a last document is transferred is to be retained in an intermediate tray or forcibly discharged therefrom.

Accordingly, an image forming apparatus of the invention comprises a document feeder for feeding a plurality of documents one by one, a copy paper feeder for feeding a copy paper sheet having a front surface and a rear surface onto which document images are transferable, image transferring means for transferring an image of the fed document onto a copy paper sheet, first determination means for determining that an image of a last document of the plurality of documents has been transferred onto one of the two surfaces of a copy paper sheet, second determination means in response to the first determination means for determining that the last document image is transferred onto a front surface of the copy paper sheet, operable means for discharging the copy paper sheet or temporarily retaining the copy paper sheet therein to refeed the sheet to the image transferring means when a next document is fed, mode setting means for selectively setting in advance either of a first mode in which the copy paper sheet onto which the last document image is transferred is forcibly discharged or a second mode in which the copy paper sheet onto which the last document image is transferred is temporarily retained in the operable means, and control means in response to the second determination means and the mode setting means for controlling the operable means so as to discharge the copy paper sheet onto the rear surface of which the image of the document is transferred, discharge the copy paper onto the rear surface of which the last document image is transferred in the case where the first mode is selected, and retain therein the copy paper onto the front surface of which the last document image is transferred in the case where the second mode is selected.

According to the image forming apparatus thus constructed, it is selected prior to a copying operation whether the copy paper sheet onto the front side of which the last document image is transferred is to be retained in the intermediate tray or forcibly discharged therefrom. When the second mode is selected with the use of the mode setting means, the copy paper sheet onto the front side of which the last document image is transferred is retained in the intermediate tray. When a first document of a next document set is fed in the ADF, the copy paper sheet retained in the intermediate tray is refed to the image transferring means so that the image of the first document is transferred onto the rear surface of the refed copy paper sheet.

On the other hand, when the first mode is selected with the use of the mode selection means, the copy paper sheet onto which the last document image is transferred is forcibly discharged irrespective of whether the last document image is transferred onto the front surface of the copy paper sheet or the rear surface thereof.

Accordingly, the operability of the image forming apparatus will be improved by properly setting the first mode or the second mode. More specifically, in the case where the documents are divided into a plurality of sets to be fed by the document feeder, the images of all the documents can be successively transferred onto the front and the rear surfaces of the copy paper sheets without wasting the last copy paper sheet for each document set. On the contrary, in the case where all the documents are fed by the document feeder in one time, the copy paper sheet onto which the last document image is transferred can be automatically discharged.

Further, the first determination means of the image forming apparatus may comprise the detection means for detecting whether the feeding of the plurality of documents is completed. Accordingly, the first determination means can easily and assuredly determine that the last document image is transferred onto one of the two surfaces of the copy paper sheet based on the detection made by the detection means.

Furthermore, the second determination means of the image forming apparatus may comprise discrimination means for discriminating whether an odd number of documents are fed by the document feeder. Accordingly, the second determination means can determine that the last document image is transferred onto the front surface of the copy paper easily and assuredly just by discriminating that an odd number of documents are fed by the document feeder.

Moreover, the discrimination means may comprise counting means for counting the number of image transferring operations executed for the documents fed by the document feeder. Accordingly, the discrimination means can easily discriminate whether an odd number of documents are fed by the document feeder just by counting the image transferring operations.

Also, the discrimination means may comprise another counting means for counting the number of the documents fed by the document feeder. Accordingly, the discrimination means can easily discriminate whether an odd number of documents are fed by the document feeder just by counting the number of the document fed thereby.

Further, the second determination of the image forming apparatus may comprise discrimination means for discriminating whether the copy paper sheet onto which the last document image is transferred is fed from the copy paper feeder. Accordingly, the second determination means can easily and assuredly determine that the last document image is transferred onto the front surface of the copy paper sheet just by discriminating that the copy paper is fed from the copy paper feeder.

The above and other objects, features and advantages of the present invention will become more apparent upon a reading of the following detailed description and drawings.

DETAILED DESCRIPTION OF THE PREFERRED EMBODIMENT OF THE INVENTION

Figure 1:
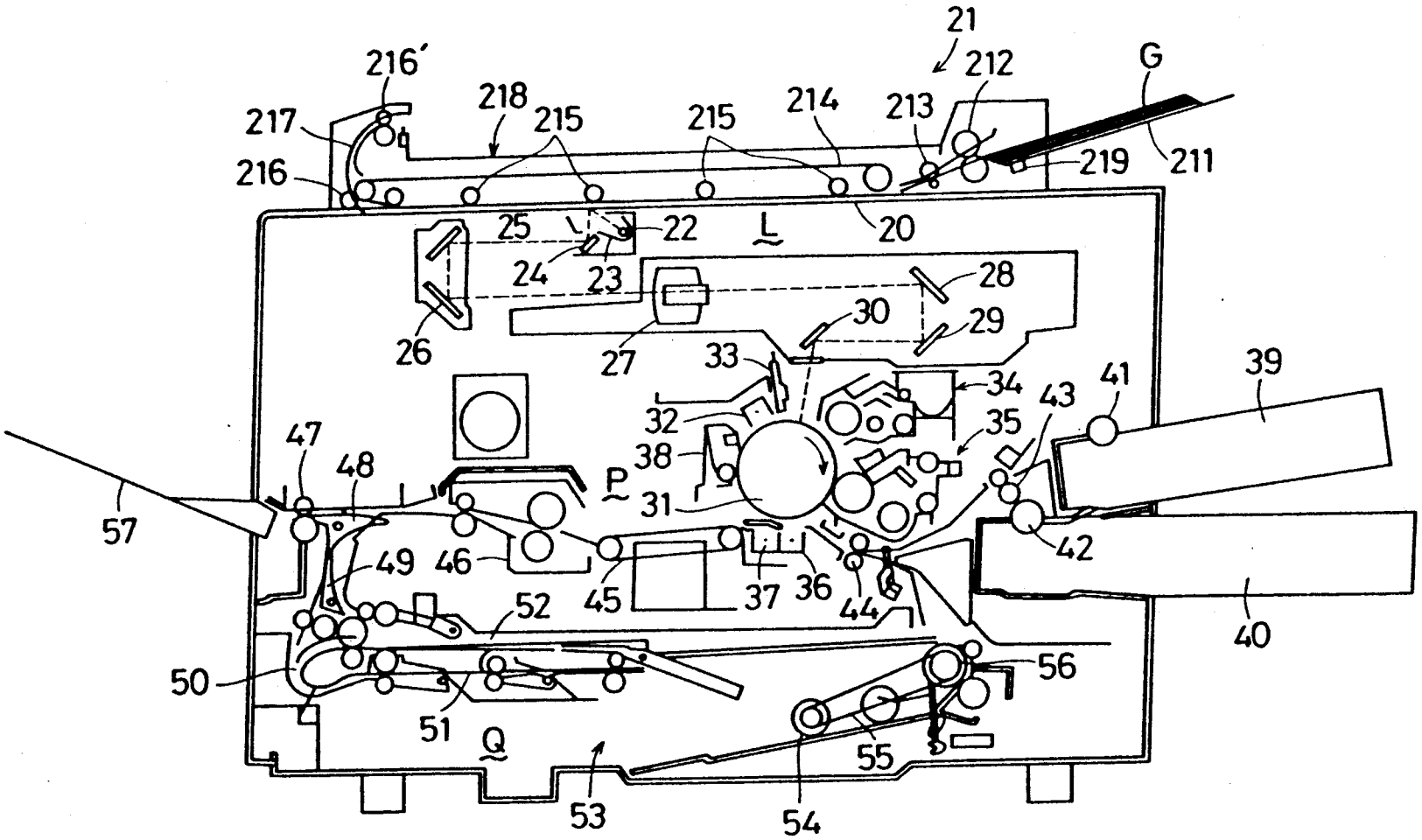
FIG. 1 is a schematic diagram showing a construction of an exemplary image forming apparatus embodying the present invention.

FIG. 1 is a schematic diagram showing an exemplary image forming apparatus embodying the invention. The image forming apparatus comprises on an upper surface thereof a contact glass 20 and an automatic document feeder (ADF) 21. Further, the image forming apparatus is internally provided with an optical system L, an image forming assembly P, and a refeeding assembly Q. Upon a duplex copy mode being set by manipulating an unillustrated control portion, images of a plurality of simplex documents G fed by the ADF 21 are transferred one by one onto successively front surfaces and rear surfaces of copy paper sheets.

The ADF 21 comprises a document holder 211, a pair of feed rollers 212, a pair of register rollers 213, a transport belt 214, transport rollers 215, pairs of discharge rollers 216, 216', a guide portion 217 for guiding the document to be discharged, a discharge tray 218, a document absence sensor 219, etc. A plurality of simplex documents G set on the document holder 211 are dispensed therefrom to the contact glass 20 one by one by the pairs of feed rollers 212 and register rollers 213. The document G is thereafter transported to a specified position on the contact glass 20 by the transport belt 214 and the transport rollers 215. Thereupon, the transport of the document is brought to a halt so that the document image is transferred onto the copy paper. Upon completion of the transferring operation, the document G is discharged through the guide portion 217 onto the discharge tray 218 by way of the transport belt 214, transport rollers 215, and the pairs of discharge rollers 216, 216'. The document absence sensor 219 is adapted for detecting whether the document is present on the document holder 211 and sending a sensor signal to a control system.

The optical system L comprises a light source having a halogen lamp 22 and a reflector 23, reflecting mirrors 24, 25, and 26, a lens portion 27, and fixed mirrors 28, 29, and 30. When the document G fed by the ADF 21 is transported to the specified position on the contact glass 20 to start the transferring operation, the light from the light source is reflected on the document G positioned on the contact glass 20. The reflected light is introduced to the lens portion 27 by way of the reflecting mirrors 24 to 26, and thereafter exposes a portion of a surface of a photosensitive drum 31 to be described below by way of the fixed mirrors 28 to 30.

The image forming assembly P comprises the photosensitive drum 31, a charger 32, a blank lamp 33, developing devices 34, 35, a transfer device 36, a separation device 37, a cleaner 38, etc. The blank lamp 33 is adapted for removing unnecessary charges on the photosensitive drum 31 so that the document image can be copied onto the copy paper sheet of designated size. The two developing devices 34, 35, are provided so as to make a multi-color copy in addition to a single-color copy. After uniformly charged by the charger 31, the surface of the photosensitive drum 31 is exposed by the above reflected light, whereby an electrostatic latent image is formed thereon. The latent image is developed with toner by the developing device 34 or 35. The developed image is thereafter transferred by the transfer device 36 in an image forming position onto the copy paper sheet, which is in turn separated from the surface of the photosensitive drum 31 by the separation device 37.

Further, cassettes 39, 40, feed rollers 41, 42, pairs of register rollers 43, 44 are arranged in this order from upstream of the feed direction of the copy paper sheet so as to feed the copy paper sheet to the image forming position. The image is to be transferred onto the fed copy paper sheet. Also, the cleaner 38 is adapted for removing the toner residual on the surface of the photosensitive drum 31 after each transferring operation.

Downstream of the photosensitive drum 31 with respect to the feed direction of the copy paper sheet are provided a transport belt 45, a fixing device 46 and a pair of discharge rollers 47, etc. After passing through the transferring operation, the document image is fixed by the fixing device 46 onto the copy paper sheet, which is discharged onto a discharge tray 57 or transported to the refeeding assembly Q.

The refeeding assembly Q comprises switching guides 48, 49, a guide portion 50, a reversing belt 51 for reversing the feed direction of the copy paper sheet, a reversing guide portion 52 where the copy paper sheet has the feed direction thereof reversed, an intermediate tray 53, a forwarding roller 54, a forwarding belt 55 and a refeeding roller 56. The switching guide 48 is adapted for switchably introducing the copy paper sheet to a path leading to the discharge rollers 47 or further to the refeeding assembly Q. The switching guide 49 is adapted for switchably opening a path along which the copy paper sheet is transported to the intermediate tray 53 with the copied surface thereof facing downward or another path along which the copy paper sheet is transported to the intermediate tray 53 with the copied surface thereof facing downward.

Upon a duplex copy mode being selected, the copy paper sheet having the front surface thereof copied is temporarily transported through the switching guides 48, 49 to the reversing guide portion 52 by the reversing belt 51. Thereafter, the reversing belt 51 has its moving direction reversed, so that the copy paper sheet is transported to the intermediate tray 53 through the guide portion 50 and temporarily retained therein. It will be noted that the copy paper sheet is retained in the intermediate tray 53 with the front surface thereof facing upward.

When the ADF 21 starts feeding the next document to the contact glass 20, the copy paper sheet retained in the intermediate tray 53 is fed to the pair of register rollers 44 by the forwarding roller 54, forwarding belt 55, and refeeding roller 56. Thereupon, the copy paper sheet waits in standby until to be fed to the image forming position with the rear surface thereof facing upward in synchronization with the start of the image transferring operation. Upon transferred, the document image is fixed by the fixing device 46 onto the rear surface of the copy paper sheet, which is discharged onto the discharge tray 57 through the pair of discharge rollers 47.

More specifically, the copy paper sheet fed from the cassette 39 or 40 is controlled to be transported to the intermediate tray 53 with the document image being copied onto only the front surface thereof. On the contrary, the copy paper sheet refed from the intermediate tray is controlled to be discharged with the document images copied on the both surface thereof.

Figure 2:
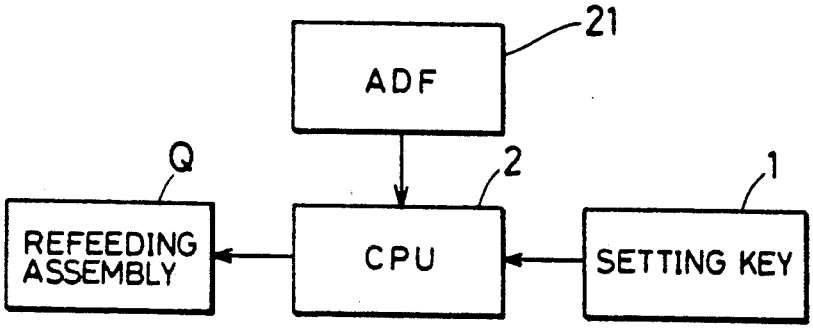
FIG. 2 is a block diagram showing a control system of the image forming apparatus.

Next, there will be described a block construction of a control system of the image forming apparatus with reference to FIG. 2.

A setting key 1 is adapted for selectively setting prior to the copying operation one of a retain mode in which the copy paper sheet onto which the last document image is transferred is to be retained in the intermediate tray 53 and a discharge mode in which the copy paper sheet onto which the last document image is transferred is discharged irrespective of whether the last document image is transferred onto the front surface or the rear surface thereof. The setting key 1 is also adapted for sending a CPU 2 a signal representative of that the retain mode is selected or that the discharge mode is selected.

The CPU 2 is adapted for controlling the operation of each part of the refeeding assembly Q in accordance with the sensor signal from the document absence sensor 219 and the signal from the setting key 1. Further, the CPU 2 discriminates whether an odd number documents are fed by the ADF 21 by counting the number of the executed transferring operations or by using a flag. Based on the result of the above determination, the CPU 2 determines whether the last document image is transferred onto the front surface of the copy paper sheet. For example, in the case where the number of executed transferring operations is counted to odd, it is determined that the last document image is transferred onto the front surface of the copy paper sheet.

Figure 3:
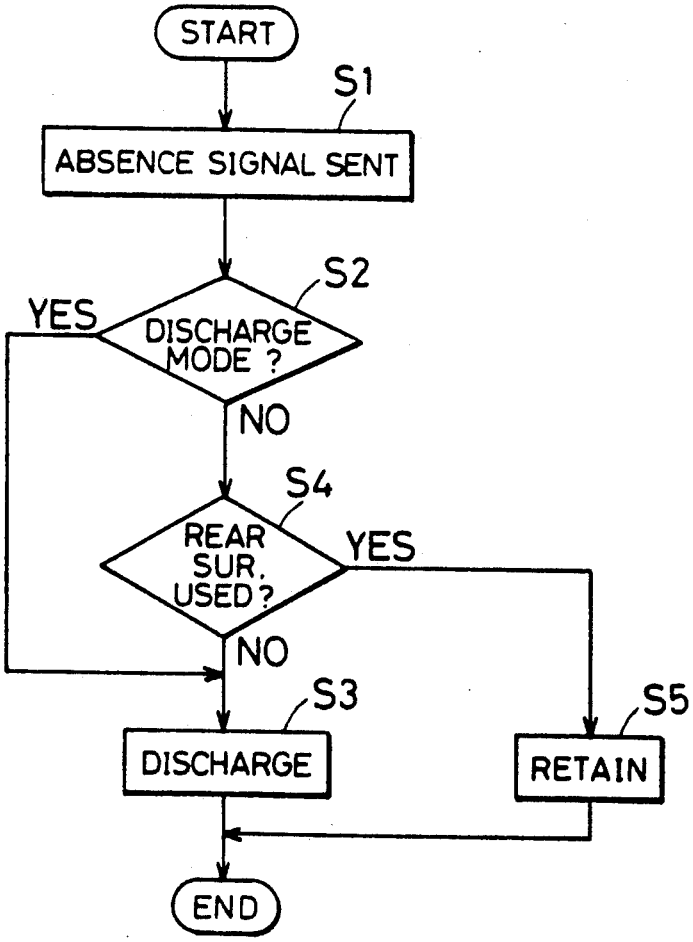
FIG. 3 is a flow chart showing an operation effected by the image forming apparatus.

Next, there will be described an operation routine of the image forming apparatus with reference to a flow chart shown in FIG. 3. It will be noted that the documents fed by the ADF 21 are alternatively copied onto the front surfaces and the rear surfaces of the copy paper sheets one by one until the document absence sensor 219 sends the sensor signal indicative of absence of the document (hereinafter referred to as an absence signal) on the document holder 211 to the CPU 2.

Upon the document absence sensor 219 sending the absence signal to the CPU 2 in Step S1, i.e., upon the last document being fed to the contact glass 20, it is discriminated whether the retain mode is selected or the discharge mode is selected in accordance with the signal sent from the setting key 1 in Step S2. In the case where the discharge mode is selected (YES in Step S2,) the copy paper sheet is discharged onto the discharge tray 57, after being copied with the image of the last document in Step S3. Specifically, when fed from the intermediate tray 53, the copy paper sheet is discharged with the last document image copied onto the rear surface thereof. On the contrary, when fed from the cassette 39 or 40, the copy paper sheet is discharged with the last document image copied onto the front surface thereof.

On the other hand, for example, in the case where the documents G are divided into a plurality of sets, the first one of which is fed by the ADF 21, and the retain mode is designated by manipulating the setting key 1 (NO in Step S2,) it is determined whether the last document image has transferred onto the front surface of the copy paper sheet, i.e., an odd number of documents have been fed by the ADF 21.

If the transferring operation is discriminated to be executed an even number of times for the documents fed by the ADF 21, it is determined that the last document image has been transferred onto the rear surface of the copy paper sheet (NO in Step S4.) Accordingly, this routine proceeds to Step S3 where the copy paper sheet is discharged onto the discharge tray 57.

On the other hand, if the transferring operation is discriminated to be executed an odd number of times, it is determined that the last document image has been transferred onto the front surface of the copy paper sheet (YES in Step S4.) Accordingly, the copy paper sheet is retained in the intermediate tray 53 in Step S5.

Thereafter, upon the next set of documents G being fed by the ADF to resume the transferring operation, the copy paper sheet retained in the intermediate tray 57 is fed therefrom to the image forming position. An image of a first document of the presently placed document set is transferred onto the rear surface of the retained copy paper sheet.

Instead of detecting the presence of the document(s) on the holder 211 and sending a sensor signal to the control system, the ADF 21 may count the number of the documents fed thereby through the use of switches and sensors provided in specified positions along the feed path. In this case, if the number of documents is counted to be odd, the CPU may effect the processings in Step S2 and subsequent Steps described with reference to the flow chart shown in FIG. 3.

Further, it may be appropriate to provide a switch in the intermediate tray 53 for detecting the presence of the copy paper sheet therein. In this case, when the copy paper sheet is retained in the intermediate tray 53 while the document is absent in the document holder 211, and the last document image is transferred onto the copy paper sheet refed from the intermediate tray 53, it is determined that the last document image is transferred onto the rear surface of the copy paper sheet. On the other hand, when the copy paper sheet is absent in the intermediate tray 53, the document is absent in the document holder 211, and the last document image is transferred onto the copy paper sheet fed from the cassette 39 or 40, it is determined that the last document image has been transferred onto the front surface of the copy paper sheet.

Furthermore, it may be appropriate to discriminate whether an odd number of documents have been fed by the ADF 21 after the copy paper sheet onot which the last document image is transferred is temporarily retained in the intermediate tray 53. If an even number of documents have been fed by the ADF 21, the copy paper sheet is forcibly discharged. On the contrary, if an odd number of documents have been fed by the ADF 21, the copy paper sheet remains to be retained in the intermediate tray 53.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An image forming apparatus comprising:

a document feeder for feeding a plurality of documents one by one;

a copy paper feeder for feeding a copy paper sheet having a front surface and a rear surface onto which document images are transferable:

image transferring means for transferring an image of the fed document onto a copy paper sheet;

first determination means for determining that an image of a last document of the plurality of documents has been transferred onto one of the two surfaces of a copy paper sheet;

second determination means in response to the first determination means for determining that the last document image is transferred onto a front surface of the copy paper sheet;

operable means for discharging the copy paper sheet or temporarily retaining the copy paper sheet therein to refeed the sheet to the image transferring means when a next document is fed;

mode setting means for selectively setting in advance either of a first mode in which the copy paper sheet onto which the last document image is transferred is forcibly discharged or a second mode in which the copy paper sheet onto which the last document image is transferred is temporarily retained in the operable means; and control means in response to the second determination means and the mode setting means for controlling the operable means so as to execute one of the operations of discharging the copy paper sheet onto the rear surface of which the image of the document is transferred, discharging the copy paper onto the front surface of which the last document image is transferred in the case where the first mode is selected, and retaining therein the copy paper onto the front surface of which the last document image is transferred in the case where the second mode is selected.

2. An image forming apparatus as defined in claim 1 wherein the first determination means comprises detection means for detecting whether the feeding of the plurality of documents is completed and the first determination means determines based on the detection of the detection means that the last document image is transferred onto one of the two surfaces of the copy paper sheet.

3. An image forming apparatus as defined in claim 1 wherein the second determination means comprises discrimination means for discriminating whether an odd number of documents are fed by the document feeder, whereby the second determination means determines that the last document image is transferred onto a front surface of the copy paper sheet when an odd number of documents are fed.

4. An image forming apparatus as defined in claim 3 wherein the discrimination means comprises counting means for counting the number of transferring operations executed for the documents fed by the document feeder.

5. An image forming apparatus as defined in claim 3 wherein the discrimination means comprises counting means for counting the number of the documents fed by the document feeder.

6. An image forming apparatus as defined in claim 1 wherein the second determination means comprises discrimination means for discriminating whether the copy paper sheet onto which the last document image is transferred is fed from the copy paper feeder, whereby the second determination means determines that the last document image is transferred onto the front surface of the copy paper when the copy paper is fed from the copy paper feeder.

* * * * *